US009879356B2

(12) United States Patent
Wittel et al.

(10) Patent No.: US 9,879,356 B2
(45) Date of Patent: Jan. 30, 2018

(54) METHOD FOR DELAMINATION OF CERAMIC HARD MATERIAL LAYERS FROM STEEL AND CEMENTED CARBIDE SUBSTRATES

(71) Applicant: Platit AG, Grenchen (CH)

(72) Inventors: Birgit Wittel, Grenchen (CH); Gunnar Lahtz, Grenchen (CH); Christian Buchel, Brugg (CH); Jan Prochazka, Selzach (CH); Andreas Lumkemann, Leuzingen (CH); Peter Walchli, Solothurn (CH); Tibor Cselle, Oberdorf (CH)

(73) Assignee: Platit AG, Grenchen (CH)

( * ) Notice: Subject to any disclaimer, the term of this patent is extended or adjusted under 35 U.S.C. 154(b) by 0 days.

(21) Appl. No.: 15/126,664

(22) PCT Filed: Mar. 18, 2014

(86) PCT No.: PCT/EP2014/055376

§ 371 (c)(1),
(2) Date: Mar. 3, 2017

(87) PCT Pub. No.: WO2015/139731

PCT Pub. Date: Sep. 24, 2015

(65) Prior Publication Data

US 2017/0204530 A1 Jul. 20, 2017

(51) Int. Cl.

| | |
|---|---|
| ***C25F 5/00*** | (2006.01) |
| ***C25F 7/00*** | (2006.01) |
| ***C25F 3/06*** | (2006.01) |

(52) U.S. Cl.
CPC ..... *C25F 5/00* (2013.01); *C25F 3/06* (2013.01); *C25F 7/00* (2013.01)

(58) Field of Classification Search
CPC ..... C25F 5/00
See application file for complete search history.

(56) References Cited

U.S. PATENT DOCUMENTS

| | | | |
|---|---|---|---|
| 6,432,219 B1 | 8/2002 | Wijngaard et al. | |
| 7,964,085 B1 * | 6/2011 | Wang | C23C 14/3414 205/640 |

(Continued)

FOREIGN PATENT DOCUMENTS

| | | |
|---|---|---|
| DE | 10 2004 009757 A1 | 8/2005 |
| DE | 10 2010 010 771 A1 | 9/2011 |

(Continued)

*Primary Examiner* — Nicholas A Smith
(74) *Attorney, Agent, or Firm* — George Pappas

(57) ABSTRACT

In order to improve a method for decoating of ceramic hard material layers from steel and cemented carbide substrates having a ceramic hard material layer on part of the surface thereof and to make it amenable to further applications, it is proposed that the workpieces (10) to be decoated be inserted—preferably with a part thereof without a ceramic hard material layer—into guard elements, preferably protective plugs, which fit in diameter and height, and be pressed into a holder (50), the holder with the workpieces (10) to be decoated be contacted with the plus pole of the current pulse driver, an either acidic or basic electrolytic bath be selected, the contacted holder be placed into the selected electrolytic bath (30), at least one electrode (20) be positioned at a predetermined distance from the holder and the latter be contacted with the negative pole of the power pulse generator (40), the decoating is performed by means of the current pulse driver, with endpoint detection being performed continuously or a control for decoating being conducted at time intervals.

19 Claims, 6 Drawing Sheets

(56) References Cited

U.S. PATENT DOCUMENTS

| | | | | |
|---|---|---|---|---|
| 2003/0168350 | A1* | 9/2003 | Velez, Jr. | C25F 7/00 205/640 |
| 2005/0241679 | A1 | 11/2005 | Rauch et al. | |
| 2008/0029407 | A1 | 2/2008 | Bayer et al. | |
| 2011/0256807 | A1 | 10/2011 | Feng et al. | |
| 2013/0240373 | A1* | 9/2013 | Kostner | C25F 1/00 205/646 |
| 2014/0034514 | A1* | 2/2014 | Cao | C25F 1/00 205/714 |

FOREIGN PATENT DOCUMENTS

| | | | | |
|---|---|---|---|---|
| EP | 0 399 049 | A1 | 11/1990 | |
| WO | 99/54528 | | 10/1999 | |
| WO | 2003085174 | A2 | 10/2003 | |
| WO | 2009132758 | A1 | 5/2009 | |
| WO | WO 2010108456 | A1 * | 9/2010 | C25F 5/00 |

* cited by examiner

METHOD FOR DELAMINATION OF CERAMIC HARD MATERIAL LAYERS FROM STEEL AND CEMENTED CARBIDE SUBSTRATES

This application claims priority from PCT application No. PCT/EP2014/055376 filed Mar. 18, 2014, the disclosure of which is incorporated herein by reference.

TECHNICAL FIELD

The invention relates to a method for decoating of ceramic hard material layers of steel and cemented carbide substrates, namely of steel and cemented carbide substrates having a ceramic hard material layer on a part of the surface thereof. Moreover, the invention relates to holders that are suitable for the method.

BACKGROUND OF THE INVENTION

Cemented carbide tools are used in, amongst others, the tool industry and usually are composed of tungsten carbide grains and cobalt as a matrix. In order to achieve an improvement of their surface properties, these tools are coated, depending on the application purpose, with a hard material layer such as, for example, titanium nitride or chromium nitride, by means of vacuum coating methods. The hard material layers may be present, depending on the application purpose of the tool, as a single layer or as a multi-layer, and they include at least one of the chemical elements Al, Ti, Cr, Si, which are in the form of oxides, nitrides, carbides or mixed compounds, e.g. carbonitrides. These hard material layers are also referred to as ceramic layers.

A decoating of the hard material layer, namely of a ceramic layer, becomes necessary if the tool is to be used again after use and re-grinding or if a defective coating is to be removed from the tool. The difficulty about decoating is caused, on the one hand, by the various applied materials that are used in a hard material layer and in the need to know whether multiple layers or a single layer are present, and, on the other hand, by the chemical instability of the cemented carbide as such.

Tools made of high speed steel are coated with the same hard material layers as cemented carbide tools. However, they are less expensive in manufacturing and due to their chemical resistance they are much easier to decoat than the cemented carbide tools.

Decoating processes are divided into groups according to various hard material layers, wherein a first group comprises Ti and Al based layers on cemented carbide tools and high speed steel tools, e. g. TiN, TiCN, TiAlN, AlTiN, TiAlN/SiN, that are present as mono-block layer, gradient-layer or multi-layer. In this case a decoating method is customary which is based on the wet-chemical removal of hard material layers using complex compositions of hydrogen peroxide solutions, and in which the cemented carbide tool is typically protected by applying a protection voltage. The decoating time when starting from a 2 μm thickness mono-block hard material layer is between 4 to 24 h and thus is very long. Similarly, the consumption of chemicals which need to be constantly renewed in the case of these very long decoating times is very high. This method fails in the case of complex layer systems such as, for example, AlTiCrN. A decoating is no longer possible.

In the case of high speed steel tools, also a wet-chemical removal of hard material layers using complex compositions of hydrogen peroxide solutions is performed, which is done without applying a protection voltage on the tool but instead at increased temperature. The decoating time when starting from a 2 μm thickness mono-block hard material layer is between 1 to 4 h.

A second group comprises Cr based layers on cemented carbide tools and high speed steel tools, e. g. CrN, AlCrN. In this case a decoating method is customary for both types of tools, which is based on the wet-chemical application of a mixture of permanganate solution and lye. Here, the consumption of chemicals is low and the decoating times of a hard material layer with a thickness of 2 μm is around 1 hour, which is relatively short.

A third group comprises CrTi based layers on cemented carbide tools and high speed steel tools, e. g. CrTiN, AlTiCrN. For these hard material layer systems with highly complex structure no chemical decoating procedures on cemented carbide tools are known. Such coated tools had to be decoated by means of mechanical methods, and the effort therefor is very high.

The decoating of high speed steel tools is based on an electrochemical method which relies on an alkaline peroxide solution with a complex composition as electrolyte. The chemicals are consumed rapidly during decoating, and accordingly the effort is very high. Moreover, this method fails in the case of some variants of AlTiCrN hard material layers.

Further decoating processes available on the market also work in the wet-chemical domain and yield good results in respect of the vulnerability of the cemented carbide tools concerning cemented carbide layer systems of the 1st and 2nd group. However, the decoating time was also unacceptably high. In the field of the decoating of the first and second group of the high speed steel tools the known processes have similar concepts as the above mentioned method.

If the known decoating processes are to be used for ceramic hard material layer systems of the third group, as far as they are applicable at all, very slow decoating times of substantially more than 24 h have to be accepted for cemented carbide tools.

The table below shows an overview of hard material layers that are known and used in industrial practice sorted by groups and by adhesion promoting layers.

| # | Layer type | Layer structure | Adhesion layer | Group |
|---|---|---|---|---|
| 1 | TiN | TiN | TiN | 1 |
| 2 | TiCN | TiN + TiCN | TiN | 1 |
| 3 | TiAlN | TiAlN | — | 1 |
| 4 | | TiN + TiAlN | TiN | 1 |
| 5 | AlTiN | AlTiN | — | 1 |
| 6 | | TiN + AlTiN | TiN | 1 |
| 7 | TiAlN/SiN | TiN + TiAlN/SiN | TiN | 1 |
| 8 | | TiN + AlTiN/SiN | TiN | 1 |
| 9 | | TiN + AlTiN + TiAlN/SiN | TiN | 1 |
| 10 | | TiN + TiAlN/SiN + TiN/SiN | TiN | 1 |
| 11 | TiAlN/SiN/AlCrON | TiN + TiAlN/SiN + AlCrON | TiN | ? |
| 12 | TiAlCrN/SiN | TiN/CrN + TiAlN/SiN + AlTiCrN/SiN + TiN/SiN | CrN o. TiN | ? |
| 13 | | TiN/CrN + TiAlCrN/SiN | CrN o. TiN | 3 |
| 14 | | TiN/CrN + AlTiCrN/SiN | CrN o. TiN | 3 |
| 15 | CrN | CrN | CrN | 2 |
| 16 | AlCrN | AlCrN | — | 2 |
| 17 | | CrN + AlCrN | CrN | 2 |
| 18 | AlCrN/TiAlN | CrN + AlCrN + TiAlN | CrN | 2 |
| 19 | AlCrN/SiN | CrN + AlCrN/SiN | CrN | 2 |
| 20 | | CrN + AlCrN + AlCrN/SiN | CrN | 2 |
| 21 | CrTiN | CrTiN | CrN or TiN | 3 |

-continued

| # | Layer type | Layer structure | Adhesion layer | Group |
|---|---|---|---|---|
| 22 | AlTiCrN | AlTiCrN | — | 3 |
| 23 | | TiN/CrN + AlTiCrN | CrN or TiN | 3 |
| 24 | | TiN/CrN + AlCrN + AlTiCrN | CrN or TiN | 3 |
| 25 | | TiN/CrN + AlCrN + AlCrTiN | CrN or TiN | 3 |

A method for decoating of cemented carbide tools is known from WO 99/54528 A1 which allows breaking off of a hard material layer from the cemented carbide tool. Thereby, a tungsten oxide layer is electrolytically formed on the cemented carbide tool which has to be subsequently removed with a mechanical post-treatment. This method is very fast, as it promises decoating times for the first and second group of less then 30 min. A disadvantage here is the need of mechanical post-treatment of the tungsten oxide layer being formed.

From WO 2003/085174 A2 there is known a method which removes surface regions from components by means of pulsed current. As an exemplary component is indicated a turbine blade made of nickel cobalt superalloy. The layer to be removed is metallic and has, in particular, the composition MCrAlY, wherein M is an element of the group of iron, cobalt or nickel. The method known from WO 2003/085174 A2 in the form disclosed therein is not suitable for decoating of ceramic layers of workpieces, namely of steel and hard metal substrates having a ceramic hard material layer on part of their surface.

SUMMARY OF THE INVENTION

The object of the present invention is to propose a method for decoating which removes from cemented carbide tools any hard material layers of the first group faster and more easily and which is able, moreover, to decoat hard material layers of the second group from cemented carbide tools and high speed steel tools, and which is able to decoat hard material layers of the third group, which so far could not be or only partially be removed chemically from cemented carbide tools and high speed steel tools, in an equally fast and easy manner.

The object of the invention is achieved by a method as described. The measures of the invention initially have the consequence that for ceramic coated cemented carbide workpieces and for workpieces with a ceramic hard material layer a method is provided which removes the ceramic layer all the way to an adhesion layer or to the hard material layer. In this manner, the workpiece is protected from chemical attack, particularly in the region where no ceramic layer is present. According to the present invention, the very thin adhesion promoting layer is removed, as the case may be, only in a second step, namely—as known and customary—with peroxidic solutions under application of a protection voltage at the tool.

Due to the fact that the decoating time in the method step according to the present invention is in the range of minutes and that also in the second, conventional step it is in the range of minutes due to the very thin adhesion layer, the hard metal is not attacked. Accordingly, the disadvantage of the method of WO 2003/085174 A2, namely that the workpiece is attacked in the region where there is no surface layer to be decoated, is eliminated.

In the case of hard material layer systems of the first and the third group without a TiN adhesion promoting layer, the method according to the present invention will result in fast decoating times, but in this case the hard metal is attacked and needs to be post-treated by means of mechanical methods such as re-grinding, burnishing or microblasting. In the case of high speed steel tools, the method according to the present invention is provided for ceramic hard material layers of the second and the third group. If an adhesion promoting layer made of TiN is present, then decoating is conducted down to this layer by means of the novel method, and in a second step this very thin adhesion promoting layer is removed by means of conventional methods. This is done by means of peroxide solutions at increased temperature. If no TiN adhesion promoting layer is present, then complete decoating is done with the method. However, it is advisable to use in a further step a conventional peroxidic decoating bath at increased temperature according to the prior art in order to remove discolorations which may arise during the use of the new method.

It is advantageous if the end point detection comprises measuring or detecting the voltage required to establish a predetermined current, the endpoint being reached when, after observing a drop of the voltage, the voltage again attains its original value.

It is particularly advantageous if the workpieces are inserted into a holder which is designed in such manner that it can receive workpieces with different diameters, thereby contacting them and simultaneously protecting the uncoated material surface from attack, and to subsequently decoat them.

Suitable and advantageous electrolytes have been proven to be 2 to 50% mineral acids with a pH value of 0.5 to −1.1, preferably 5 to 25% nitric acid with a pH value of 0.09 to −0.7 and a compound concentration c=0.81 to 4.54 mol/dm$^3$, and most preferably 8 to 15% nitric acid with a pH value of −0.12 to −0.41 and a compound concentration c=1.32 to 2.58 mol/dm$^3$ as acid electrolyte and a solution of 1 L water, 10 ml to 500 ml of a 50% lye with a pH value of 13.1 to 14.8 and a compound concentration c=0.14 mol/dm$^3$ to 6.9, preferably 20 ml to 100 ml of a 50% lye with a pH value of 13.4 to 14.1 and a compound concentration c=0.27 to 1.36 mol/dm$^3$ and most preferably 30 ml to 80 ml of a 50% KOH with a pH value of 13.6 to 14.0 and a compound concentration c=0.40 to 1.0 mol/dm$^3$ and 4 g to 55 g of an oxidation agent, preferably 10 g to 35 g of a permanganate with a compound concentration c=0.06 to 0.23 mol/dm$^3$ and most preferably 15 g to 25 g potassium permanganate with a compound concentration c=0.095 to 0.158 mol/dm$^3$ as basic electrolyte.

In the case of an acidic electrolyte it is advantageous if the power supply supplies a current of 10 A to 50 A, preferably 20 A to 40 A and most preferably 26 A to 35 A, which is current-controlled and pulsed, preferably unipolar and most preferably unipolar with a rectangular pulse shape with a frequency of 1 Hz to 40 Hz, preferably 2 Hz to 20 Hz and most preferably 3 Hz to 8 Hz and a sampling rate (duty cycle) greater than 25%, preferably greater than 50% and most preferably greater than 75%.

In contrast, in the case of a basic electrolyte it is advantageous if the power supply supplies a current of 50 A to 200 A, preferably 80 A to 150 A and most preferably 90 A to 115 A, which is current-controlled and pulsed, preferably unipolar and most preferably unipolar with a rectangular pulse shape with a frequency of 5 Hz to 40 Hz, preferably 10 Hz to 35 Hz and most preferably 20 Hz to 30 Hz and a sampling rate of 10 Hz to 35 Hz and most preferably 20 Hz to 30 Hz and a sampling rate (duty cycle) smaller than 50%, preferably smaller than 35% and most preferably smaller than 25%.

An advantageous holder for carrying out the method for a plurality of workpieces comprises a conductive base housing with electrical contacts and at least one current supply, a cover with bore openings and seals for different plugs, with bore openings and seals for different plugs, which in turn are preferably provided with bores with different diameters.

It is advantageous if the holder, the base housing and the cover as well as the current supply rails are coated with an electrically isolating coating, wherein the isolating material is resistant against chemicals and is not applied at the contacting surfaces, and that the plugs, which are provided with bores with different diameters in order to receive different diameters of workpieces, are made of electrically non-conductive materials that are chemically resistant, preferably made of polyoxymethylene. Thereby, the plugs can be provided with o-rings, in order to prevent chemicals from penetrating between the workpiece and the plug.

An advantageous holder for carrying out the method with workpieces, particularly hobs, having uncoated surfaces in several regions thereof, has an isolating base plate in which a steel mounting with electrical contacts and current supply is incorporated serving as anode and simultaneously protecting the workpiece to be received therein from chemical attack and holding the workpiece preferably in a standing manner. A conductive cylinder provided as a cathode which can be contacted via an electrical contact has a plastic plug 60 which protects the workpiece from chemical attacks at other locations. Thereby, the cylinder, the plastic mounting and the steel mounting are configured to be exchangeable in order to cover and to contact the different sizes and shapes of workpieces.

The aforementioned elements as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Further details, advantages and features of the object of the present invention will become apparent from the following description and the corresponding drawings, in which methods for decocting of ceramic hard material layers according to the present invention are illustrated by way of example. In the drawings there are shown in.

DETAILED DESCRIPTION OF THE PREFERRED EMBODIMENTS

Figure 1:
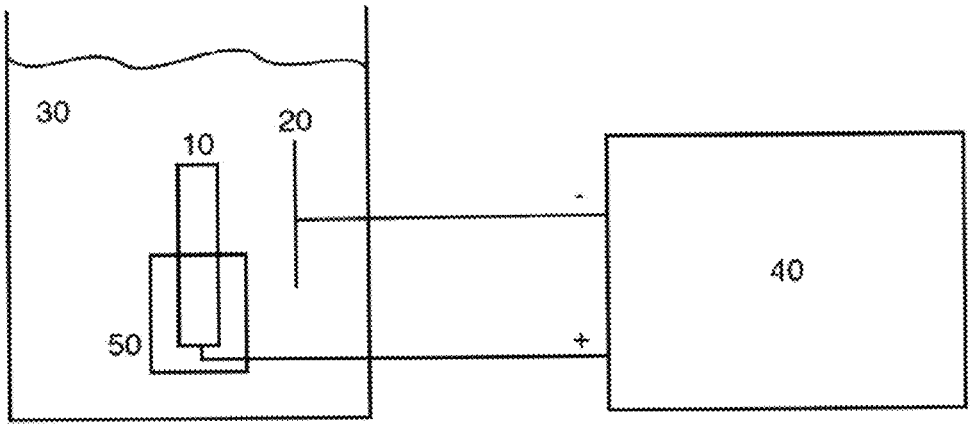
FIG. 1 a schematic view of the arrangement for carrying out the method according to a first exemplary embodiment of the present invention with a holder for a plurality of workpieces.
Figure 2:
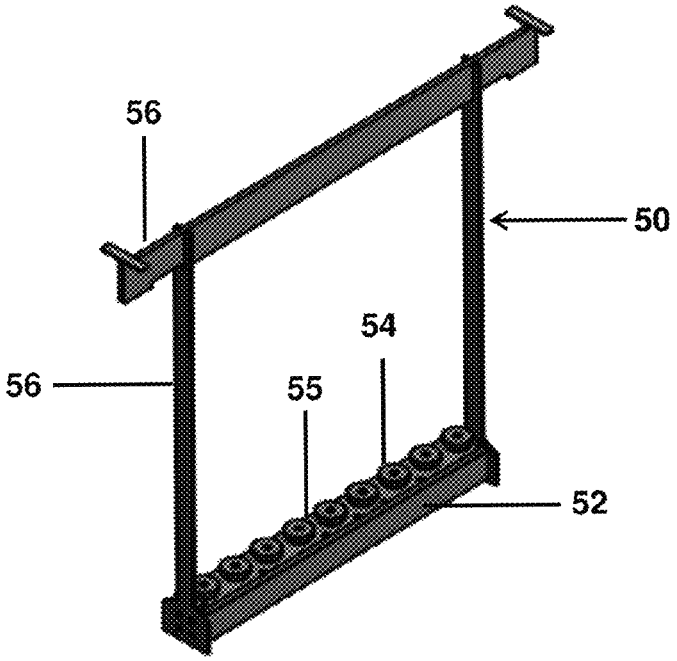
FIG. 2 a perspective view of a holder for mounting of a plurality of workpieces, in this case of shaft tools for positioning in an electrolyte.

The hard material layers of the first group and the third group can have a layer structure comprising a TiN adhesion promoting layer with a layer thickness of <0.5 μm between the tool and the actual hard material layer. This forms a transition phase to the actual functional hard material layer.

It has been found that these hard material layers of the first and the third group can be selectively decoated from the surface down to the adhesion layer made of TiN within a very short time using a suitable wet-chemical approach and applying electrical pulses.

Moreover, it was apparent from the experiments that in case the hard material layers do not have a TiN adhesion layer between the hard metal tool and the hard material layer the decoating can be carried out by means of the same wet-chemical approach and by means of electrical pulses in an equally fast manner. This is especially true for the hard material layers of the second group. However, in this case the hard metal tool is attacked at the surface thereof and has to be post-treated.

Moreover, it was found in experiments that the hard material layers of the second and the third group can be selectively decoated within a very short time from the surface either down to the adhesion layer made of TiN or, in the absence of such an adhesion layer made of TiN, down to the surface of the high speed steel tool in a suitable wet-chemical approach by means of electrical pulses.

Hard material layers of the first group on high speed steel tools cannot be de-coated with this method because the wet-chemical approach used here destroys the high speed steel substrate.

In the case of pulsed decoating, the coated tool serves as a positive pole (electrical anode), whereas steel shields or steel rings or other metal objects serve as negative pole (electrical cathode). The electrolyte used depends on the ceramic components in the hard material layer.

Hence, for the hard material layers classified as above, two different electrolyte media are employed, namely for hard material layers of the first group, that is Ti, Al based layers, an acidic electrolyte, which in the exemplary embodiment described here consists of 10 to 15% nitric acid (c=1.67 to 2.58 mol/l) and a pH value of −0.23 pH to −0.41 pH, and for hard material layers of the second and the third group, that is Cr and CrTi based layers, a basic electrolyte, which in the exemplary embodiment described here consists of 1 L water with 50 mL KOH 50% (c=0.67 mol/l) and 20.6 g potassium permanganate (c=0.13 mol/l) and a pH value of the solution of 13.5. In the exemplary embodiment described here, both electrolytes are operated at room temperature. Now a uniformly positive current-pulsed signal is induced by means of a pulse generator until the decoating has started occurring. The decoating time starting with a 2 μm thickness hard material layer is between 10 secs and 5 min, depending on the hard material layer, the electrolyte used and the tool material used.

The applied current for a given tool depends on the coated surface, and accordingly also on the diameter and geometry of the tool, on the type of the ceramic coating, and thus also on the electrolyte, and can be specifically determined in experiments. The applied current for a cemented carbide end mill (Ø=8 mm. coated length 40 mm) with a coating of the layer type of the second group with a layer thickness of 3 μm which is decoated in the basic electrolyte, is about 10 to 11 A. The applied current for the same cemented carbide end mill tool as described above, but coated with a layer type of the first group, which is decoated with an acidic electrolyte, is 3 A. If several tools are clamped into the holder, then the tools act as resistors in a parallel circuit.

In the case of high speed steel tools, the same dependences were found as in the case of cemented carbide tools. The applied current for a high speed steel tool with a diameter between 6 mm to 12 mm which is decoated in the basic electrolyte is 10 to 11 A. In the acidic electrolyte a corresponding decoating is not possible because the tool would be destroyed.

The frequency of the pulse and its function shape are also critical parameters for this type of the decoating. A current-controlled pulse mode, preferably with a uniform geometry and most preferably with a rectangular bipolar pulse shape, is used. The frequency of the pulse in the case of the basic electrolyte is 5 Hz to 40 Hz, preferably 10 Hz to 35 Hz and most preferably 20 Hz to 30 Hz, and a sampling rate (duty cycle) smaller than 50%, preferably smaller than 35% and most preferably smaller than 25% is used. In the case of the acidic electrolyte, the frequency is 1 Hz to 40 Hz, preferably 2 Hz to 20 Hz and most preferably 3 Hz to 8 Hz and a sampling rate (duty cycle) greater than 50%, preferably greater than 70% and most preferably greater than 85% are used.

The TiN adhesion layer remaining on the tools is subsequently decoated by means of a wet-chemical method suitable for the base material, that is high speed steel or cemented carbide. By using e.g. hydrogen peroxide solutions, where the cemented carbide tool is protected by applying a protection voltage, the TiN adhesion layer can be removed within 5 to 10 min. The cemented carbide is not attacked in such short time.

If hard material layer systems which do not comprise a TiN adhesion layer are decoated with the pulsed method, then the cemented carbide is attacked in the acidic as well as in the basic electrolyte. Then, a post-treatment by means of re-grinding or microblasting or burnishing is necessary. Also, a slight attack on high speed steel tools can occur by applying the basic electrolyte. However, this attack is only minimal and causes a slight optical dulling of the surface.

Non-coated surfaces such as, for example, shafts of end mill tools are attacked by the pulsed method in acidic and in basic electrolyte and therefore have to be covered by a suitable holder with protection plugs. For shaft tools a holder with protection plugs was specifically developed for the pulsed decoating method. However, the holder can also used e. g. for other chemical decoating methods in which attacks on the cemented carbide can occur. The holder serves the purpose of receiving shaft tools with different diameters, thereby contacting them and simultaneously protecting the uncoated shaft surface from attack and for subsequently decoating it with the pulsed method.

Figure 3:
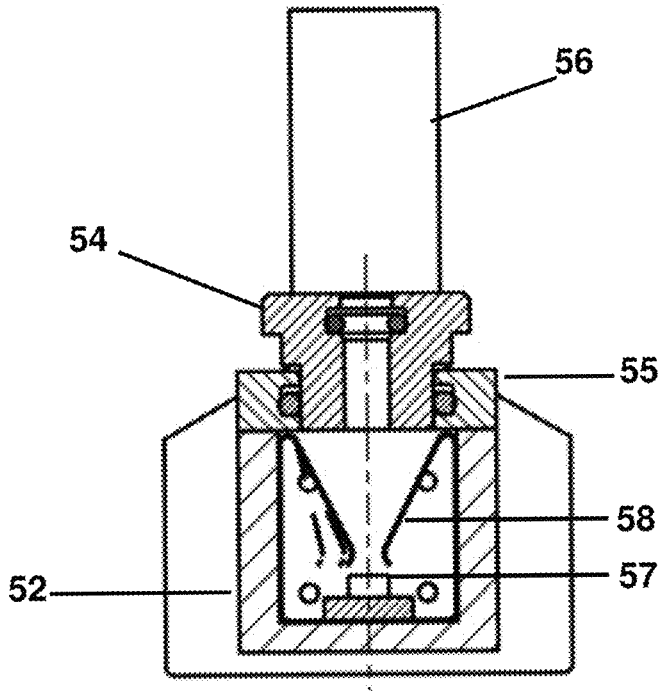
FIG. 3 a detailed view of the functional elements according to FIG. 2.
Figure 4:
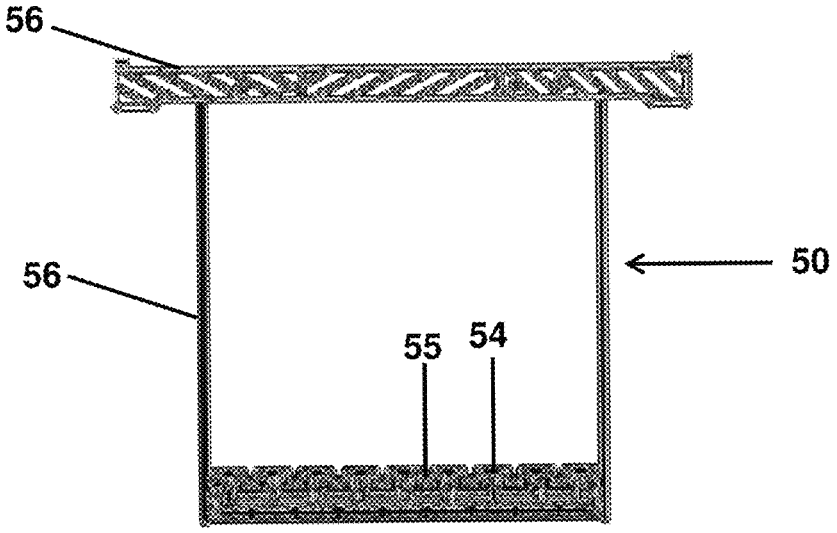
FIG. 4 a view from the side onto the holder according to FIGS. 2 and 3.

The holder 50 for shaft tools comprises a conductive base housing 52 with electrical contacts and at least one current supply element, which in the present exemplary embodiment are current supply rails 56, a cover 55 with bore openings and seals for different plugs 54, which in turn are preferably provided with bores with different diameters. The base housing 52, cover 55 and current supply rails 56 are coated with an isolator wherein the isolating material has to be resistant against chemicals and may not be applied at the contacting surfaces. The plugs 54 which are provided with bores with different diameters in order to receive different diameters of shaft tools are made of non-conductive materials that are chemically resistant. The height of the plugs varies in order to cover non-coated shaft lengths with different heights. The plugs 54 are provided with o-rings in order to prevent chemicals from penetrating between the shaft and the plug 54. Moreover, in FIG. 3 there is shown a contact rail 57 on which rests the tool 10, and a two-side contact coil 58, wherein the contact rail 57 serves as a clamping device for the contact coil.

A characteristic feature in the use of the holder in combination with the guiding plugs is the fact that after pulsed decoating and subsequent removal of the TiN adhesion layer a small ring of non-decocted or slightly attacked surface remains on the shaft tool since a small overlap between the plugs and the coated shaft surface and/or a small overlap between the free shaft surface and the electrolyte is present.

A special embodiment of a holder servers the purpose of receiving e.g. hobs with different diameters, thereby contacting them and simultaneously protecting the uncoated material surface from attack, and of subsequently decoating them with the pulsed method.

The holder comprises a base plate 75 in which an isolating mounting 74 is incorporated and which protects the workpiece 10 to be received therein from chemical attack and holds the workpiece 10 preferably in a standing manner. An electrical contact 76 for the workpiece serves as anode, and there is a conductive cylinder 72 which is provided as a cathode and which can be contacted via an electrical contact, and an isolating plug 60 which protects the workpiece 10 from chemical attacks at other locations. The cylinder 72, the isolating mounting 74 and the isolating plug 60 can be exchanged in order to cover and to contact the different sizes and shapes of workpieces 10.

The method for decoating of shaft tools is carried out in the exemplary embodiment described here—shown in FIG. 1—as follows:

1. The shaft tools 10 to be decoated are inserted into protection plugs that are matching in diameter and height and pressed into the holder 50.
2. The holder with the shaft tools 10 to be decoated is contacted with the plus pole of a current pulse driver 40.
3. It must be decided which electrolytic bath 30 shall be used, namely an acidic electrolyte for layers of the first group and a basic electrolyte for layers of the second and the third group.
4. The contacted holder 50 is placed into the selected electrolytic bath.
5. Two electrodes 20 made of steel are placed on both sides of the holder and the latter is contacted with the negative pole of the current pulse driver. The distance of the electrodes made of steel to the shaft tool is 0.5 cm to maximally 2.5 cm.
6. At the pulse generator 40 the conditions are adjusted for shaft tools (with a diameter of 6 mm to 12 mm). Thereby, nine shaft tools per decoating are assumed. The holders in the exemplary embodiment described here are designed for nine tools.

| layers of the 1st group: | layers of the 2nd and 3rd group: |
|---|---|
| 1st Example:<br>Number of shaft tools 9 with<br>diameter of 12 mm<br>current: 15 A<br>voltage ($U_{0Max}$): 40 V<br>current-controlled,<br>pulse shape rectangular<br>frequency 5 Hz<br>symmetry/sampling rate: 98% | 1st Example:<br>Number of shaft tools 9 with<br>diameter of 12 mm<br>current: 100 A<br>voltage ($U_{0Max}$): 50 V<br>current-controlled,<br>pulse shape rectangular<br>frequency 25 Hz<br>symmetry/sampling rate: 20% |
| 2nd Example:<br>Number of shaft tools 9 with<br>diameter of 6 mm<br>current: 15 A<br>voltage ($U_{0Max}$): 40 V<br>current-controlled,<br>pulse shape rectangular<br>frequency 5 Hz<br>symmetry/sampling rate: 98% | 2nd Example:<br>Number of shaft tools 9 with<br>diameter of 6 mm<br>current: 100 A<br>voltage ($U_{0Max}$): 50 V<br>current-controlled,<br>pulse shape rectangular<br>frequency 25 Hz<br>symmetry/sampling rate: 20% |

7. Decoating begins immediately.
8. In the case of shaft tools 10 of the first group an end point detection is used.
   In the case of tools of the first group, an effect was surprisingly detected which may serve as end point detection. The electrical power supply provides a function of the current during the decoating time whereby a constant, exactly stable current is generated. Due to the fact that during the decoating process the surface of the tools and therefore, also the resistance is changed, a drop of the voltage is found. When the titanium nitride layer is reached, the resistance increases until the voltage reaches its original value. Hereby, the voltage curve is in the range of about 2 to 10 V and a voltage difference of about 2 to 4 V is to be expected.
   In the case of tools of the second and third group the current supply is stopped every 20 to 30 seconds, and the holder with the shaft tools is controlled with respect to decoating.
9. In the case of a layer with a thickness of 2 μm decoating down to the tool or the TiN adhesion layer is completed, depending on the composition of the hard material layer, within 10 seconds to 30 minutes.

Subsequently the TiN adhesion layer is completely decoated with a conventional wet-chemical approach. Decoating without a TiN adhesion layer requires the same pulsed decoating time. A further chemical decoating is not necessary, but a mechanical post-treatment is carried out due to the attacks of the substrate.

Figure 5:
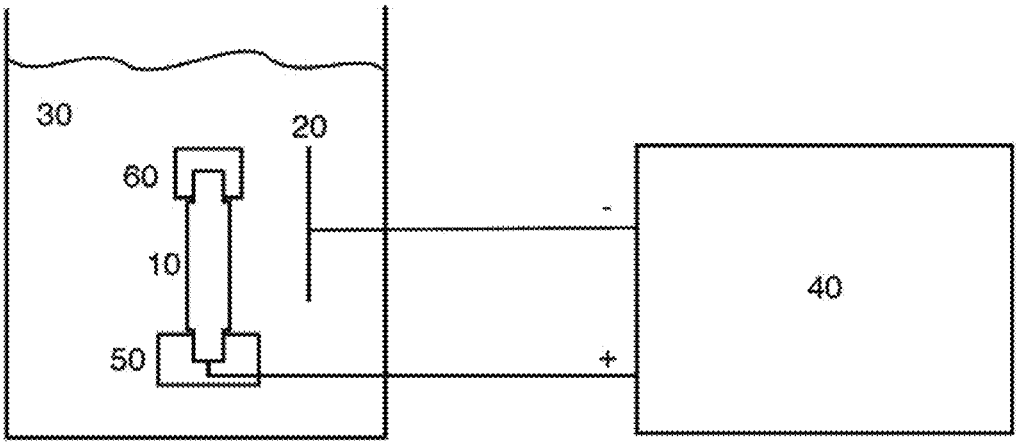
FIG. 5 a schematic view of the arrangement for carrying out the method according to a second exemplary embodiment of the present invention.
Figure 6:
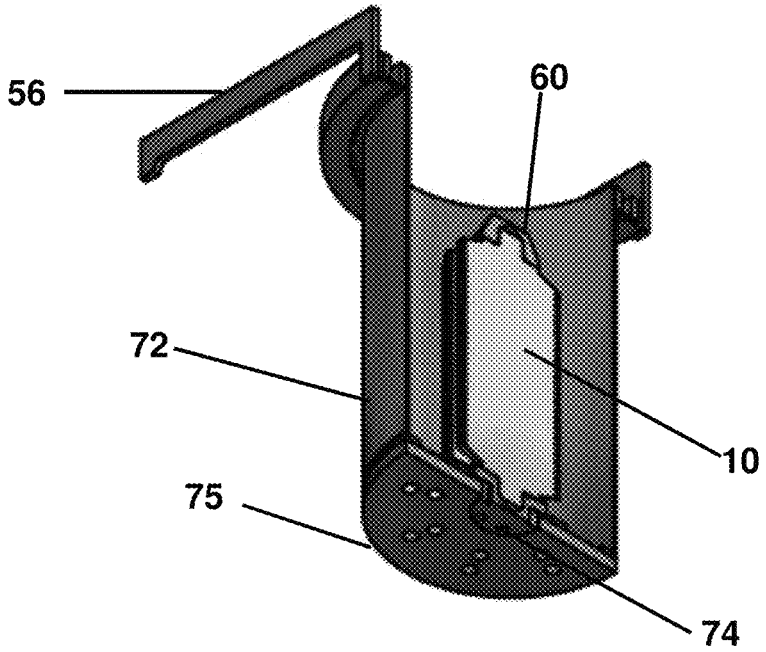
FIG. 6 a perspective view of an alternative holder for mounting of a workpiece, here of a hob, in which the surface to be decocted is located between two uncoated regions thereof, according to the arrangement of FIG. 5.
Figure 7:
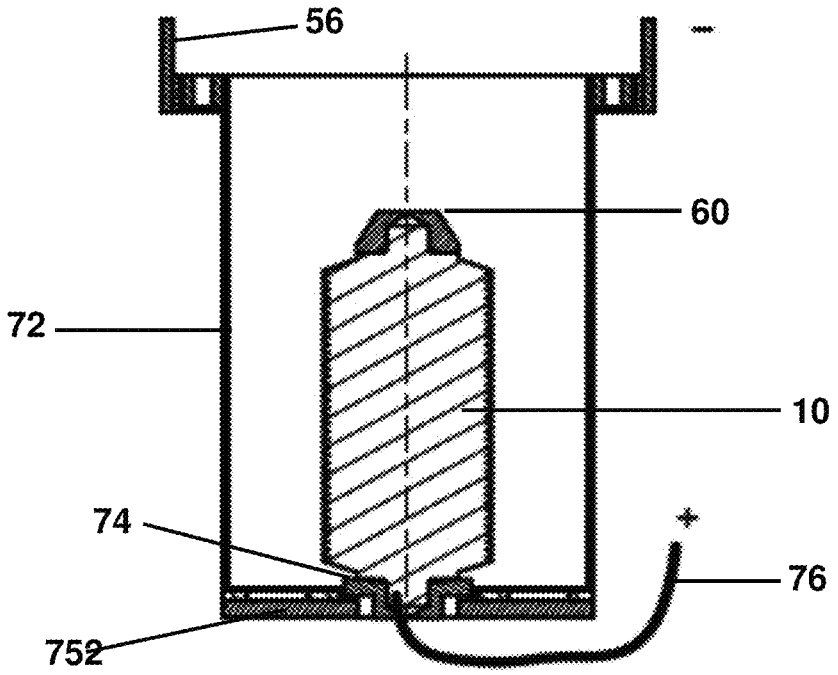
FIG. 7 a detailed view of the functional elements according to FIG. 6.
Figure 8:
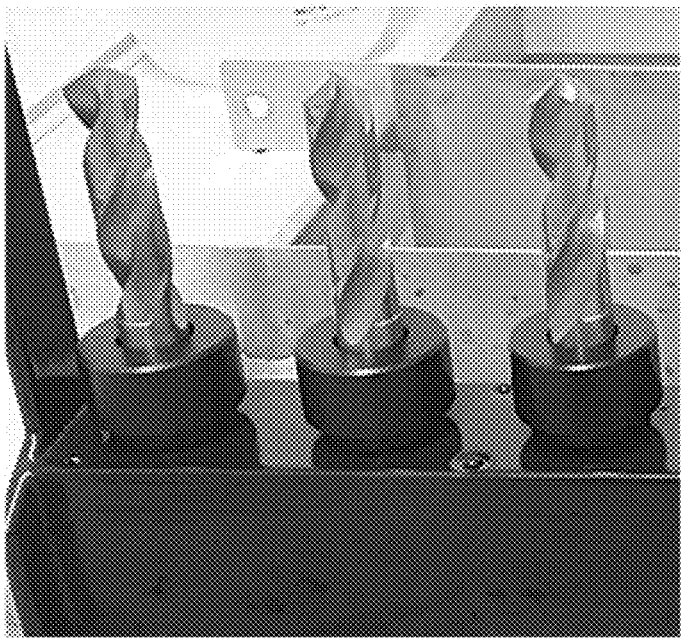
FIG. 8 a perspective view, namely a photograph of the holder according to FIGS. 2 to 4, into which shaft tools are inserted.
Figure 9:
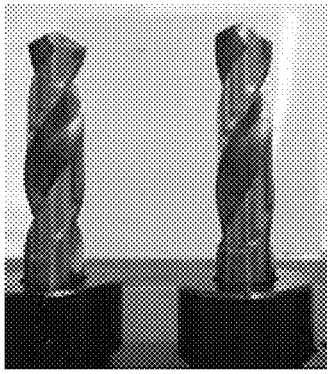
FIG. 9 a view, namely a photograph of the holder according to FIGS. 2 to 4, into which shaft tools are inserted.
Figure 10:
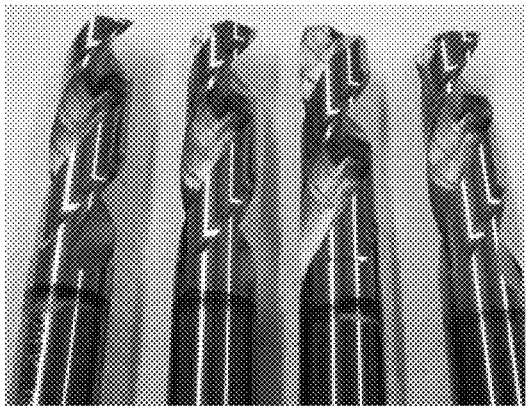
FIG. 10 a view, namely a photograph of the shaft tools according to FIGS. 8 and 9, after decoating.
Figure 12:
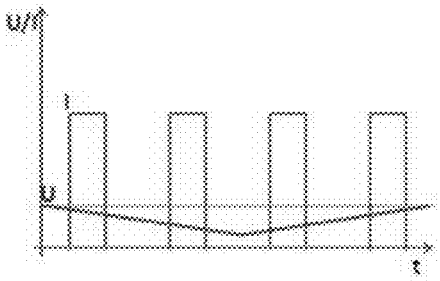
FIG. 12 a view of the voltage curve which can be used for the end point detection.
Figure 11:
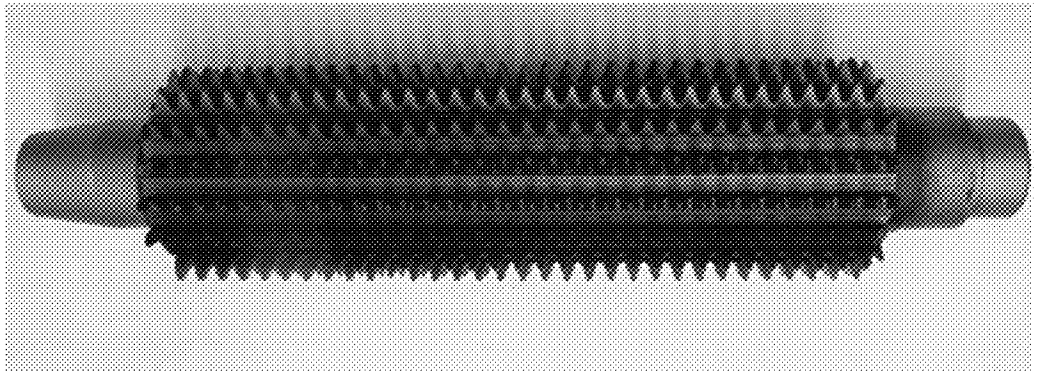
FIG. 11 a perspective view, namely a photograph of a workpiece for insertion into the holder according to FIGS. 5 to 7.

A slightly different process is provided in an exemplary embodiment for decoating hobs, as shown in FIG. 5:

1. The hob 10 to be decoated is contacted with the plus pole of the current pulse driver 30 and placed into the holder according to FIGS. 6 and 7 and provided with a protection plug 60.
2. It must be decided which electrolytic bath 30 shall be used, namely an acidic electrolyte for layers of the first group and a basic electrolyte for layers of the second and third group.
3. The contacted hob 10 is placed into the selected electrolytic bath 30. A steel ring electrode made of stainless steel that was gold coated is centrally placed at a distance of 0.5 cm to maximally 2.5 cm around the hob. This steel electrode is connected with the negative pole of the pulse generators 30.
4. At the pulse generator 30 the conditions are adjusted for the hob 10.

| Layers of the 1st group: | Layers of the 2nd and 3rd group: |
|---|---|
| 1st Example:<br>hob with a diameter of 47 mm; height 1510 mm<br>current: 30 A<br>voltage ($U_{0Max}$): 40 V<br>current-controlled,<br>pulse shape rectangular<br>frequency 5 Hz<br>symmetry/sampling rate: 98% | 1st Example:<br>hob with a diameter of 47 mm; height 1510 mm<br>current: 30 A<br>voltage ($U_{0Max}$): 50 V<br>current-controlled,<br>pulse shape rectangular<br>frequency 25 Hz<br>symmetry/sampling rate: 20% |
| 2nd Example:<br>hob with a diameter of 33 mm; height 110 mm<br>current: 30 A<br>voltage ($U_{0Max}$): 40 V<br>current-controlled,<br>pulse shape rectangular<br>frequency 5 Hz<br>symmetry/sampling rate: 98% | 2nd Example:<br>hob with a diameter of 33 mm; height 110 mm<br>current: 30 A<br>voltage ($U_{0Max}$): 50 V<br>current-controlled,<br>pulse shape rectangular<br>frequency 25 Hz<br>symmetry/sampling rate: 20% |

5. Switch on the pulse generator 30. Decoating begins immediately.
6. The current supply is stopped every 20 to 30 seconds, and the holder 50 with the hob 10 is controlled with respect to decoating.
7. In the case of a layer with a thickness of 2 μm decoating down to the TiN adhesion layer is completed, depending on the composition of the hard material layer, within 1 minute to 10 minutes.

Subsequently the TiN adhesion layer is completely decoated with a conventional wet-chemical approach. Decoating without a TiN adhesion layer requires the same pulsed decoating time. A further chemical decoating is not necessary, but a mechanical post-treatment is carried out due to the attacks of the substrate.

EXAMPLES FOR DECOATING

Example 1

Nine cemented carbide shaft tools (spiral drills d=12 mm, K type) with an AlTiN layer (layer type table: layer #6) with a thickness of 3.4 μm and a TiN adhesion promoting layer were inserted into the specifically developed holder with protection plugs and immersed into a 10% nitric acid solution acting as electrolyte, and decoated down to the TiN adhesion layer with a pulsed current $I_{Function}$ of 15 A with a frequency of 5 Hz and a sampling rate of 98%. The steel electrodes had a distance to the cemented carbide tool of 1 to 2 cm. The decoating time was 2 min and was terminated by the end point detection.

In a further process step according to the state of the art, the TiN adhesion layer is completely decoated in a peroxidic decoating bath under the application of a protection voltage on the shaft tools. Here, the decoating time is about 5 to 10 min. After decoating, no attacks on the tools were found in the scanning electron microscope.

Example 2

A cemented carbide hob (d=470 mm) with an AlTiN layer (layer type table: layer #6) with a thickness of 7.2 μm, a coloring cover layer consisting of Al, Ti, N and a TiN adhesion promoting layer was immersed into a 12% nitric acid solution acting as electrolyte, and decoated down to the TiN adhesion layer with a pulsed current $I_{Function}$ of 30 A with a frequency of 5 Hz and a sampling rate of 98%. The ring steel electrode had a distance to the cemented carbide tool of 1.5 cm. The decoating time was 3 min.

Example 3

Nine cemented carbide rods (d=6 mm, K type) each with a TiAlN/SiN layer (layer type table: layer #7) with a thickness of 3.7 μm and a TiN adhesion promoting layer were inserted into the specifically developed holder with protection plugs and immersed into a 12% nitric acid solution acting as electrolyte, and decoated down to the TiN adhesion layer with a pulsed current $I_{Function}$ of 15 A with a frequency of 5 Hz and a sampling rate of 98%. The steel electrodes had a distance to the cemented carbide tool of 1 to 2 cm. The decoating time was 2 min and was terminated by the end point detection.

Example 4

Nine cemented carbide shaft tools (d=12 mm, K type) with an AlTiCrN layer (layer type table: layer #23) with a thickness of 3.1 μm and a TiN adhesion promoting layer were inserted into the specifically developed holder with protection plugs and immersed into a basic solution of potassium permanganate with the following composition: 1L $H_2O$; 50 ml KOH (50%); 20.6 g $KMnO_4$ and decoated down to the TiN adhesion layer with a pulsed current $I_{Function}$ of 100 A with a frequency of 25 Hz and a sampling rate of 20%. The steel electrodes had a distance to the cemented carbide tool of 1 to 2 cm. The decoating time was 2 min. In a further process step according to the state of the art, the TiN adhesion layer is completely decoated in a peroxidic decoating bath under the influence of a protection voltage on the shaft tools. Here, the decoating time was about 5 to 10 min. After decoating, no attacks on the tools were found in the scanning electron microscope.

Example 5

A cemented carbide hob (d=470 mm) with an AlTiCrN layer (layer type table: layer #23) with a thickness of 5.7 μm and a TiN adhesion promoting layer was immersed into a basic solution of potassium permanganate with the following composition: 1L $H_2O$; 50 ml KOH (50%), 20.6 g $KMnO_4$ acting as electrolyte, and decoated down to the TiN adhesion layer with a pulsed current $I_{Function}$ of 30 A with a frequency of 25 Hz and a sampling rate of 20%. The ring steel electrode had a distance to the cemented carbide tool of 1 to 2 cm.

Example 6

Nine cemented carbide rods (d=10 mm, K type) with an AlTiCrN layer (layer type table: layer #22) each with a thickness of 3.4 μm without a TiN adhesion promoting layer were inserted into the specifically developed holder with protection plugs and immersed into a basic solution of potassium permanganate with the following composition: 1L $H_2O$; 50 ml KOH (50%); 20.6 g $KMnO_4$ acting as electrolyte, and decoated down to the TiN adhesion layer with a pulsed current $I_{Function}$ of 100 A with a frequency of 25 Hz and a sampling rate of 20%. The steel electrodes had a distance to the cemented carbide tool of 1 to 2 cm. The decoating time was 2 min. The substrate was attacked. Thereafter, the attacked surface was wet-blasted at 1.5 bar. The surface was examined by REM. A roughening of the surface can be recognized in this case.

In a comparative milling test, on the one hand with a cemented carbide tool which was decoated without a TiN adhesion layer and then recoated, and on the other hand with a new tool which was only coated, conducting the following working steps

- coating with AlTiCrN without a TiN adhesion layer
- decoating with the pulsed method/$KMnO_4$ basic
- wet-blasting with F400A at 1.2 bar
- wet-sharpening of the front face (decoated tools and one new tool)
- Edge treatment in the Otec (KV1:2/25 rpm/5 min)
- coating with AlCrN
- Otec: Polish walnut (Topping)
- quality control: Alicona, SEM
- Fehlmann: milling test!

gave the following result: After a once only reprocessing of cemented carbide end mills a considerable tool life of approximately 80% as compared to a new tool is possible.

Example 7

Eight high speed steel tools (d=6 mm, standard) each with an AlCrTiN layer (layer type table: layer #25) with a thickness of 2.8 μm with a TiN adhesion promoting layer were inserted into the specifically developed holder with protection plugs and immersed into a basic solution of potassium permanganate with the following composition: 1L $H_2O$; 50 ml KOH (50%); 20.6 g $KMnO_4$ acting as electrolyte, and decoated down to the TiN adhesion layer with a pulsed current $I_{Function}$ of 100 A with a frequency of 25 Hz and a sampling rate of 20%. The steel electrodes had a distance to the cemented carbide tool of 1 to 2 cm. The decoating time was 2 min. In a further process step according to the state of the art, the TiN adhesion layer is completely decoated in a peroxidic decoating bath under the influence of a protection voltage on the shaft tools. Here, the decoating time was about 10 to 15 min.

Example 8

A high speed steel hob (d=700 mm) with an AlTiCrN layer (layer type table: layer #22) with a thickness of 2.6 μm without a TiN adhesion promoting layer was immersed into a basic solution of potassium permanganate with the following composition: 1L $H_2O$; 50 ml KOH (50%); 20.6 g $KMnO_4$ acting as electrolyte, and decoated down to the TiN adhesion layer with a pulsed current $I_{Function}$ of 30 A with a frequency of 25 Hz and a sampling rate of 20%. The steel electrodes had is a distance to the high speed steel hob of 1.0 cm. The decoating time was 11 min. In a further process step according to the state of the art, the brownish discoloration which was formed by the pulsed decoating is removed in a peroxidic decoating bath at increased temperature. Here, the length of stay in the bath was about 5 min.

The invention claimed is:

1. A method for decoating of ceramic hard material layers from at least one workpiece which workpiece is one or more cutting tools having a ceramic hard material layer on a part of a surface of the cutting tool and an adhesion layer underneath the ceramic hard material layer, wherein at least one electrode is arranged as a cathode in an electrolytic liquid, wherein the one or more cutting tools acting as anode are also arranged at least partially in said electrolyte liquid, wherein a pulse driver means for generating voltage pulses is arranged between the cathode or the cathodes and the anode or the anodes, and wherein guard elements are provided, comprising the steps that the one or more cutting tools to be decoated are inserted into the guard elements that are matching in diameter and height and pressed into a holder, that the holder with the one or more cutting tools to be decoated is contacted with the plus pole of the pulse driver means, that an acidic electrolytic bath is selected, that the contacted holder is placed into the selected electrolytic bath, at least one electrode is placed at a predetermined distance from the holder and is contacted with the negative pole of the pulse driver means, and that the decoating is performed by means of the pulse driver means, wherein a continuous end point detection is carried out, wherein the end point detection comprises measuring or determining the voltage which is required to establish a specific current, the endpoint being reached when, after observing a drop of the voltage, the voltage again reaches its original value, wherein a 2 to 50% mineral acid with a pH value of 0.5 to −1.1 is used as electrolyte.

2. The method according to claim 1, characterized in that the one or more cutting tools are inserted into a holder, thereby contacting them and simultaneously protecting the uncoated material surfaces from attack, and to subsequently decoat them.

3. The method according to claim 1, characterized in that the power supply supplies a current of 10 A to 50 A at a voltage ($U_{0Max}$) of 20 V to 60 V, which is current-controlled pulsed with a frequency of 3 Hz to 8 Hz and a sampling rate greater than 50%.

4. The method according to claim 1, wherein a holder is used for said one or more cutting tools having uncoated surfaces in several regions thereof, the holder having a base plate in which an isolating mounting protects the one or more cutting tools to be received therein from chemical attack, an electrical contact for the current supply acting as anode, a conductive cylinder provided as a cathode and which can be contacted via electrical contacts, and an isolating plug which protects the one or more cutting tools from chemical attacks at other locations.

5. The method according to claim 4, characterized in that a holder is used in which the cylinder, the isolating mounting and the isolating plug are configured exchangeable in order to cover and to contact one or more cutting tools with various sizes and shapes.

6. The method according to claim 3, wherein a holder is used for one or more cutting tools having uncoated surfaces in several regions thereof, the holder having a base plate in which an isolating mounting protects the one or more cutting tools to be received therein from chemical attack, an electrical contact tor the current supply acting as anode, a conductive cylinder provided as a cathode and which can be contacted via electrical contacts, and an isolating plug which protects the one or cutting tools from chemical attacks at other locations.

7. The method according to claim 6, characterized in that a holder is used in which the cylinder, the isolating mounting and the isolating plug are configured exchangeable in order to cover and to contact one or more cutting tools with various sizes and shapes.

8. The method according to claim 5, characterized in that the cutting tools are hobs and said conductive cylinder provided as a cathode is contacted via a current rail.

9. The method according to claim 7, characterized in that the cutting tools are hobs and said conductive cylinder provided as a cathode is contacted via a current rail.

10. The method according to claim 1, characterized in that the cutting tool is composed of tungsten carbide grains and cobalt as a matrix.

11. The method according to claim 10, characterized in that the adhesion layer comprises TiN.

12. The method according to claim 11, characterized by a further step of removing the adhesion layer using a peroxide decoating bath under the influence of a protection voltage on the cutting tool.

13. A method for decoating of ceramic hard material layers from workpieces which workpieces are cutting tools having a ceramic hard material layer on a part of the surface of the cutting tool, wherein at least one electrode is arranged as a cathode in an electrolytic liquid, wherein the cutting tools acting as anodes are also arranged at least partially in said electrolyte liquid, wherein a pulse driver means for generating voltage pulses is arranged between the cathode or the cathodes and the anode or the anodes, and wherein guard elements are provided, comprising the steps that the cutting tools to be decoated are inserted into the guard elements that are matching in diameter and height and pressed into a holder, that the holder with the cutting tools to be decoated is contacted with the plus pole of the pulse driver means, that an acidic electrolytic bath is selected, that the contacted holder is placed into the selected electrolytic bath, at least one electrode is placed at a predetermined distance from the holder and is contacted with the negative pole of the pulse driver means, and that the decoating is performed by means of the pulse driver means, wherein a control for decoating at time intervals is carried out, wherein a 2 to 50% mineral acid with a pH value of 0.5 to −1.1 is used as electrolyte, and wherein said power supply is designed in such manner that it supplies a current of 10 A to 50 A at a voltage (U0Max) of 20 V to 60 V, which is current-controlled pulsed with a frequency of 3 Hz to 8 Hz and a sampling rate greater than 50%.

14. The method according to claim 13, characterized in that the cutting tool is composed of tungsten carbide grains and cobalt as a matrix.

15. A method for decoating of ceramic hard material layers from at least one workpiece which workpiece is a hob having a ceramic hard material layer on a part of the surface of the hob and having uncoated surfaces in several regions, wherein at least one electrode is arranged as a cathode in an electrolytic liquid, wherein the hob or the hobs acting as anode are also arranged at least partially in said electrolyte liquid, wherein a pulse driver means for generating voltage pulses is arranged between the cathode or the cathodes and the anode or the anodes, and wherein guard elements are provided, comprising the steps that the hob to be decoated are inserted into the guard elements that are matching in diameter and height and pressed into a holder, that the holder with the hob to be decoated is contacted with the plus pole of the pulse driver means, that an acidic electrolytic bath is selected, that the contacted holder is placed into the selected electrolytic bath, at least one electrode is placed at a predetermined distance from the holder and is contacted with the negative pole of the pulse driver means, and that the decoating is performed by means of the pulse driver means, wherein a control for decoating at time intervals is carried out, wherein a 2 to 50% mineral acid with a pH value of 0.5 to −1.1 is used as electrolyte, wherein a holder is used for hobs, having uncoated surfaces in several regions thereof, the holder having a base plate in which an isolating mounting protects the hobs to be received therein from chemical attack, an electrical contact for the current supply acting as anode, a conductive cylinder provided as a cathode and which can be contacted via electrical contacts, and an isolating plug which protects the workpiece from chemical attacks at other locations.

16. The method according to claim 15, characterized in that a holder is used in which the cylinder, the isolating mounting and the isolating plug are configured exchangeable in order to cover and to contact said hobs with various sizes and shapes.

17. The method according to claim 15, characterized in that the cutting tools are hobs and said conductive cylinder provided as a cathode is contacted via a current rail.

18. The method according to claim 15, characterized in that the power supply is designed in such manner that it supplies a current of 10 A to 50 A at a voltage (U0Max) of 20 V to 60 V, which is current-controlled pulsed with a frequency of 3 Hz to 8 Hz and a sampling rate greater than 50%.

19. The method according to claim 15, characterized in that the cutting tool is composed of tungsten carbide grains and cobalt as a matrix.

* * * * *